US007958763B2

(12) United States Patent
Ligda

(10) Patent No.: US 7,958,763 B2
(45) Date of Patent: Jun. 14, 2011

(54) APPARATUS AND PROCESS FOR REDUCING PROFILE VARIATIONS IN SHEET METAL STOCK

(75) Inventor: Andrew Michael Ligda, Shelby Township, MI (US)

(73) Assignee: LTC Roll & Engineering Co., Clinton Township, MI (US)

( * ) Notice: Subject to any disclaimer, the term of this patent is extended or adjusted under 35 U.S.C. 154(b) by 694 days.

(21) Appl. No.: 11/843,366

(22) Filed: Aug. 22, 2007

(65) Prior Publication Data

US 2008/0047318 A1 Feb. 28, 2008

Related U.S. Application Data

(60) Provisional application No. 60/839,827, filed on Aug. 24, 2006.

(51) Int. Cl.
*B21D 5/08* (2006.01)
*B21D 13/00* (2006.01)
*B21B 1/16* (2006.01)

(52) U.S. Cl. ..... 72/181; 72/198; 72/379.6

(58) Field of Classification Search ..... 72/181, 72/196–198, 379.6, 108, 199, 226, 234, 240, 72/252.5

See application file for complete search history.

(56) References Cited

U.S. PATENT DOCUMENTS 535,648 A * 3/1895 Watson ..... 72/197
2,213,507 A 9/1940 Ungerer
3,686,917 A * 8/1972 Hikida et al. ..... 72/196
3,956,915 A * 5/1976 Saunders ..... 72/199
4,269,055 A * 5/1981 Sivachenko et al. ..... 72/181
4,651,549 A 3/1987 Masui
4,745,788 A 5/1988 Takemasa et al.
4,806,300 A 2/1989 Walton et al.
4,986,105 A * 1/1991 Hoglund ..... 72/180
5,038,592 A 8/1991 Knudson
5,295,303 A * 3/1994 Ogawa et al. ..... 72/385
5,305,625 A 4/1994 Heinz
6,643,931 B2 11/2003 Nees
6,971,691 B1 12/2005 Heatherington et al.
6,986,536 B1 1/2006 Heatherington et al.
2006/0090339 A1 * 5/2006 Issagholian-Havai ..... 29/890.14

OTHER PUBLICATIONS

International Search Report dated Feb. 25, 2008 for International Application No. PCT/US07/76523, International Filing Date Aug. 22, 2007 (4 pages).

Written Opinion of the International Searching Authority dated Feb. 25, 2008 for International Application No. PCT/US07/76523, International Filing Date Aug. 22, 2007 (7 pages).

* cited by examiner

*Primary Examiner* — Teresa M Ekiert
(74) *Attorney, Agent, or Firm* — Hansen IP Law PLLC

(57) ABSTRACT

An apparatus and process for reducing variations in the profile of a sheet metal stock are shown and described. The process includes the use of two passes, each comprising two smoothing surfaces. The smoothing surfaces of each pass are mateable to define a profile between the smoothing surfaces. The profile defined between the smoothing surfaces of the first pass is substantially the inverse of the profile defined between the smoothing surfaces of the second pass. As a sheet metal is processed between the first and second passes, it is formed with the first profile and the second profile thereby reducing variations in the profile of the sheet metal.

15 Claims, 8 Drawing Sheets

APPARATUS AND PROCESS FOR REDUCING PROFILE VARIATIONS IN SHEET METAL STOCK

CROSS REFERENCE TO RELATED APPLICATION

This application claims the benefit of U.S. provisional application 60/839,827 filed on Aug. 24, 2006, the entirety of which is incorporated herein by reference.

FIELD

A sheet metal forming apparatus and process are shown and described. More particularly, the sheet forming apparatus and process are used to reduce variations such as unevenness in the profile of sheet metal stock, including stock used for roll forming, stamping, or pressing operations.

BACKGROUND

Sheet metal forming processes are used to form a sheet metal stock into a desired shape and size. Sheet metal forming processes include but are not limited to stamping, pressing, and roll forming. Roll forming processes are typically used to form parts having a desired cross-section from a generally flat roll stock. In contrast to stamping processes, roll forming is well suited for use with high strength materials. Typical roll forming processes use a number of pairs of rotatable rolls. Each pair of rolls defines a particular cross-sectional shape that is imparted to the roll-stock as it passes through and is compressed between the rolls as they rotate. As the roll stock moves from one roll pair to the next, it is progressively formed into the desired cross-sectional shape. Because the roll stock is fed as a continuous length of steel, a cut-off press or similar device is used to separate each formed section into discrete parts. The process can be used to form a wide variety of parts, including automotive parts such as bumpers, door beams, and rocker panels.

Buyers of roll-formed parts, such as automotive OEMs, typically impose specifications on the cross-sectional profile of the parts. Such specifications are particularly important if the parts are intended to mate with other complementary parts because profile variations can prevent satisfactory alignment and mating. However, certain desirable roll forming stocks, such as high strength Martensite steels, have significant variations in their profiles, such as areas of concavity, convexity, bumps, or other profile distortions. Such profile variations in the roll-stock can make it difficult or impossible to meet the buyer's specifications for the finished part. Similar problems can arise in sheet metal stocks used for stamping and pressing operations. Accordingly, a need has arisen for a means of reducing profile variations in sheet metal stocks.

SUMMARY

An apparatus for reducing profile variations in a sheet material includes a first pass having first and second smoothing surfaces that are mateable to define a first profile between the first and second smoothing surfaces and a second pass having third and fourth smoothing surfaces that are mateable to define a second profile between the third and fourth smoothing surfaces, wherein the first profile is substantially the inverse of the second profile. In certain exemplary embodiments, the first pass comprises a first roll including the first smoothing surface and a second roll including the second smoothing surface. In further exemplary embodiments, the second pass comprises a second roll including the third smoothing surface and a fourth roll including the fourth smoothing surface. In certain other exemplary embodiments, the first pass comprises an upper die platen and a lower die platen, the first pass upper die platen includes the first smoothing surface, and the first pass lower die platen includes the second smoothing surface. In additional exemplary embodiments, the second pass comprises an upper die platen and a lower die platen, the second pass upper die platen comprises the third smoothing surface, and the second pass lower die platen comprises the fourth smoothing surface.

An apparatus for reducing profile variations in roll stock comprises a first pass including a first roll and a second roll. The first roll and the second roll each have surface features. The surface features of the first roll are substantially complementary to the surface features of the second roll. The apparatus further comprises a second pass including a third roll and a fourth roll. The third roll and the fourth roll each have surface features, such that the surface features of the third roll are substantially complementary to the surface features of the fourth roll. The surface features of the third roll are also complementary to the surface features of the first roll.

In certain embodiments, the first roll has a first plurality of raised surface regions and a second plurality of depressed surface regions, the second roll has a third plurality of raised surface regions and a fourth plurality of depressed surface regions, the first plurality of raised surface regions is substantially aligned with the fourth plurality of depressed surface regions, the third plurality of raised surface regions is substantially aligned with the second plurality of depressed surface regions, the third roll has a fifth plurality of raised surface regions and a sixth plurality of depressed surface regions, the fourth roll has a seventh plurality of raised surface regions and an eighth plurality of depressed surface regions, the fifth plurality of raised surface regions is substantially aligned with the eighth plurality of depressed surface regions, the seventh plurality of raised surface regions is substantially aligned with the sixth plurality of depressed surface regions, and the first plurality of raised surface regions is substantially aligned with the sixth plurality of depressed surface regions.

In other embodiments, the first roll has a length, and the surface features of the first roll comprise a plurality of ridges spaced apart along the length of the first roll. In other embodiments, the first roll has a circumference and the plurality of ridges is disposed around the circumference of the first roll. In further embodiments, the first roll, the second roll, the third roll, and the fourth roll are corrugated.

An apparatus for reducing profile variations in a roll stock moving in a processing direction comprises a first smoothing pass spaced apart from a second smoothing pass in the processing direction. The first smoothing pass comprises a roll having a first plurality of raised surface regions and a second plurality of depressed surface regions. The second pass comprises a roll having a third plurality of raised surface regions and a fourth plurality of depressed surface regions. The first plurality of raised surface regions is substantially aligned with the fourth plurality of depressed surface regions, and the third plurality of raised surface regions is substantially aligned with the second plurality of depressed surface regions. In additional embodiments, the first smoothing pass roll is an upper roll, the first smoothing pass further comprises a lower roll, the second smoothing pass roll is an upper roll, and the second smoothing pass further comprises a lower roll.

A method for reducing surface variations in roll stock having a width comprises deforming the roll stock in a first direction at a first plurality of locations that are spaced apart along the width of the roll stock and deforming the roll stock in a second direction at the first plurality of locations, wherein the first direction is substantially opposite from the second direction. In certain embodiments, the step of deforming the roll stock in a first direction at a first plurality of locations further comprises substantially contemporaneously deforming the roll stock in the second direction at a second plurality of locations that are spaced apart along the width of the roll stock. In other embodiments, the step of deforming the roll stock in a first direction at a first plurality of locations comprises passing the roll stock between a first corrugated roll and a second corrugated roll. In further embodiments, the step of deforming the roll stock in a second direction at the first plurality of locations comprises passing the roll stock between a third corrugated roll and a fourth corrugated roll.

A method for reducing profile variations in a sheet metal stock comprises providing a sheet metal, forming the sheet metal in the shape of a first profile, and forming the sheet metal in the shape of a second profile, wherein the first and second profiles are substantially inverses of one another. In certain embodiments, the step of forming the sheet metal in the shape of a first profile comprises passing the sheet metal between a first smoothing surface and a second smoothing surface, wherein the first profile is defined between the first smoothing surface and the second smoothing surface. In additional embodiments, the step of forming the sheet metal in the shape of a second profile comprises passing the sheet metal between a third smoothing surface and a fourth smoothing surface, wherein the second profile is defined between the third smoothing surface and the fourth smoothing surface.

IN THE DRAWINGS

DETAILED DESCRIPTION

Described below are exemplary apparatuses and processes for reducing profile variations in sheet materials, in particular, sheet metal stock that is used in stamping, pressing, or roll forming processes. To illustrate the apparatuses and processes, roll forming operations will be described. However, the use of roll forming is exemplary and other sheet metal forming operations—including without limitation stamping and pressing—may be used without departing from the spirit and scope of the claimed invention. In general, the apparatuses and methods described below involve a first smoothing operation in which the sheet metal is formed with a first profile and a second smoothing operation in which the sheet metal is formed with a second profile, wherein the first and second profiles are substantially the inverse of one another. By subjecting the sheet metal stock to sequential forming operations that use substantially inverse profiles, a flatter, more even material is obtained. In certain illustrative systems, two passes sequentially form the substantially inverse profiles on the sheet metal, wherein each pass comprises pairs of smoothing surfaces. Each smoothing surface in the pair includes alternating raised and depressed surface regions. The surfaces are aligned to be substantially complementary to one another so that they are mateable to form the desired profile in a sheet metal stock placed between the surfaces.

Figure 1:
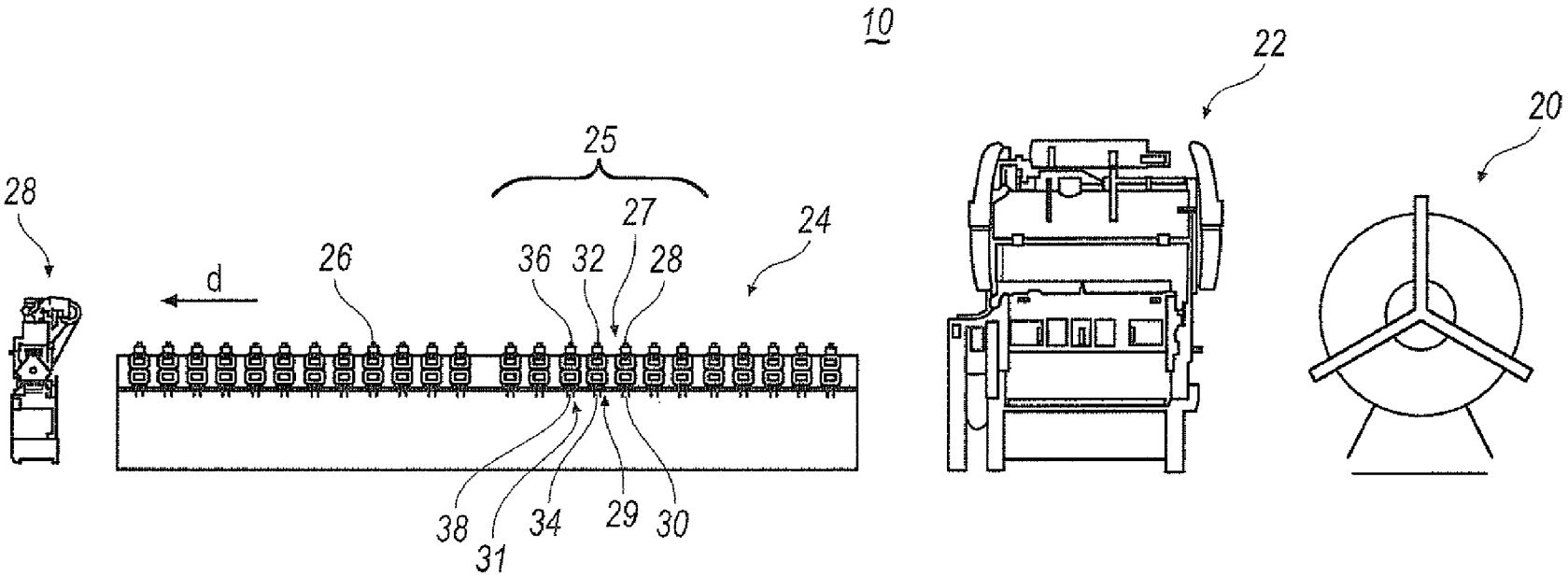
FIG. 1 is a depiction of a roll forming process used to illustrate a method and apparatus for reducing profile variations in roll stock.

By way of example, a roll forming process 10 is described in FIG. 1. At the front end of process 10, a pay off reel or uncoiler 20 is provided. Uncoiler 20 is used to feed a roll-stock to the downstream equipment in process 10. Uncoiler 20 comprises a rotatable core, around which the roll stock is coiled. Rotation of the core incrementally feeds the roll stock to the downstream processing equipment.

Pre-notch press 22 is a well-known type of hydraulic press and is provided downstream of uncoiler 20. For certain roll-formed parts, such as rocker panels, it is desirable to form a pattern of one or more apertures at selected locations along the part. Pre-notch press 22 is configured to stamp out apertures at the desired locations. Although pre-notch press 22 is depicted immediately downstream of uncoiler 20, it can be located elsewhere in process 10, including downstream of roll mill 24.

Roll mill 24 comprises a plurality of roll-forming passes 26, each comprising an upper and lower roll that are substantially in vertical alignment with one another. Each roll is generally cylindrical and rotatable about its longitudinal axis. The roll stock is fed to and compressed between the upper and lower rolls of each pass as they rotate to impart a defined cross-sectional shape to the roll stock. The specific number of passes and their particular cross-sectional shape are selected based on the desired part configuration and roll-stock material. In addition, one or more of the passes may be temperature controlled by contacting the part with a coolant in order to prevent the part from overheating.

Roll pairs 26 are preferably configured to sequentially modify the cross-section of the roll stock as it advances in processing direction "d." Roll mill 24 is also preferably configured to allow the removal or addition of passes 26 based on the particular product and roll stock material. The roll stock eventually exits roll mill 24 with the desired cross-sectional profile.

In order to create a plurality of discrete parts from a continuous roll-stock, cut-off press 28 is provided, Cut-off press 28 is of the type known in the art and is configured to sever the formed roll-stock to create pre-defined part lengths. In addition to the equipment shown in FIG. 1, secondary operations, such as additional presses, may be included to provide additional forming operations. For example, in rocker panel operations, a press may be provided to add offset regions at various locations along the part.

To reduce costs associated with the manufacture of products that include roll-formed parts, it is desirable to use high strength, low weight roll stocks, such as certain high strength Martensitic steels. However, roll stock suppliers typically impose few or no profile specifications on their roll stocks. As a result, roll stocks with significant profile variations—such, as concavities, convexities, bumps, and other surface irregularities—are often provided to part manufacturers. To address these variations, roll mill 24 preferably includes a smoothing section 25 which is configured to reduce profile variations in the roll stock. In an especially preferred embodiment, smoothing section 25 is provided upstream of roll forming passes 26. However, it may be provided at other locations in the process. In particular, smoothing section 25 may be located upstream of pre-notch press 22.

In the embodiment of FIG. 1, smoothing section 25 comprises first smoothing pass 27, second smoothing pass 29, and an optional third smoothing pass 31. First smoothing pass 27 includes upper roll 28 and lower roll 30, while second smoothing pass 29 includes upper roll 32 and lower roll 34. Rolls 28, 30, 32, and 34 are each mounted on respective shafts about which they rotate as roll stock is fed through them (see FIG. 4).

The upper and lower rolls comprising each smoothing pass 27 and 29 are preferably mateable. The upper and lower rolls preferably include surface regions, which are preferably raised and depressed surface regions. The raised and depressed surface regions preferably define profiles on the surfaces of the upper and lower rolls which are substantially complementary such that they substantially fit together in an interlocking manner at the location of tangency between the upper and lower rolls, save for the spacing required to accommodate the roll stock between them. These raised and depressed surface regions on the upper and lower rolls deform the roll stock at a plurality of locations along its width as it pass between the rolls. In an especially preferred embodiment, smoothing passes 27 and 29 are configured so that roll-stock locations that are raised in pass 27 are depressed in pass 29, and vice-versa. Sequentially deforming the roll stock in opposite directions by subjecting it to substantially inverse profile forming operations improves its overall smoothness and reduces profile variations. In an especially preferred embodiment, rolls 28, 30, 32, and 34 are corrugated to provide their respective patterns of alternating raised and depressed regions. As a result, the raised surface regions of the rolls define a plurality of ridges.

In addition to using a plurality of raised and depressed surface regions, rolls 28, 30, 32, and 34 may simply include a plurality of raised surface regions without depressed surface regions. Conversely, the rolls may include a plurality of depressed surface regions without using a plurality of raised surface regions.

Figure 2:
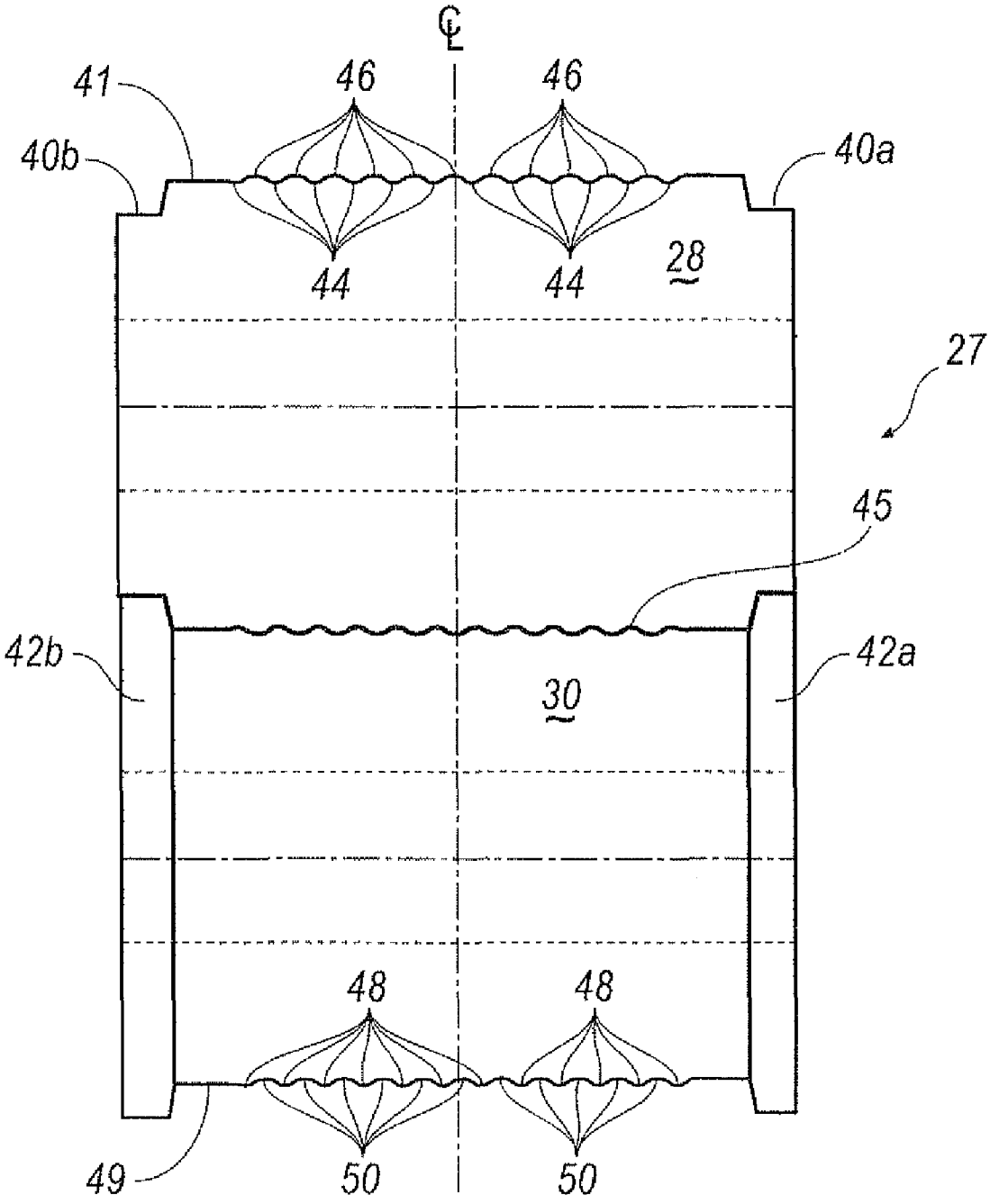
FIG. 2 is a front elevational view of an embodiment of a first smoothing pass of the roll mill depicted in FIG. 1.

Referring to FIG. 2, a detailed view of first smoothing pass 27 is provided. In the view of FIG. 2, the roll stock is not shown. Smoothing pass 27 comprises upper roll 28 and lower roll 30. Both rolls are generally cylindrical in nature and include alternating raised and depressed surface regions along their lengths. For example, upper roll 28 includes raised surface regions 46 that project away from reference surface 41 in a first direction and depressed surface regions 44 that project away from reference surface 41 in a second, opposite direction. Both raised surface regions 46 and depressed surface regions 44 preferably extend around the circumference of roll 28. Similarly, lower roll 30 has raised surface regions 48 and depressed regions 50 around its circumference, which form a similar pattern along the length of lower roll 30. As shown in FIG. 2, raised surface regions 48 and depressed surface regions 50 project away from reference surface 49 in opposite directions with respect to on another.

As shown in FIG. 2, raised surface regions 46 of upper roll 28 are substantially aligned with and complementary to depressed surface regions 50 of lower roll 30. As a result, upper roll 28 and lower roll 30 are mateable to define a profile 45 between upper roll 28 and lower roll 38 at the location where the rolls are tangent to one another. In a preferred embodiment, each raised surface region 46 has a maximum point that is substantially aligned with a corresponding minimum point of one of depressed regions 50. In one embodiment, raised surface regions 46 are convex and depressed regions 50 are concave. However, a variety of shapes can be used for the raised and depressed surface regions, such as generally square shapes or other polygonal shapes. Conversely, depressed surface regions 44 of upper roll 28 are substantially aligned with and complementary to raised surface regions 48 of lower roll 30. Depressed regions 44 and raised regions 48 may also be concave and convex, respectively, and preferably include substantially aligned maxima and minima. In addition, lower roll 30 preferably includes opposite lower roll flanges 42*a* and 42*b* which substantially mate with corresponding recessed portions 40*a* and 40*b* at opposite ends of upper roll 28. The use of the roll flanges 42*a* and 42*b* and recessed portions 40*a* and 40*b* facilitates the secure retention of the roll stock between upper roll 28 and lower roll 30. As a roll stock passes through first smoothing pass 27, those portions of it which are aligned with raised regions 46 and depressed regions 50 are deformed in the downward direction, whereas those portions which are aligned with depressed regions 44 and raised regions 48 are deformed in the upward direction. Thus, as a roll forming stock is passed through rolls 28 and 30 it is formed with profile 45.

Figure 3:
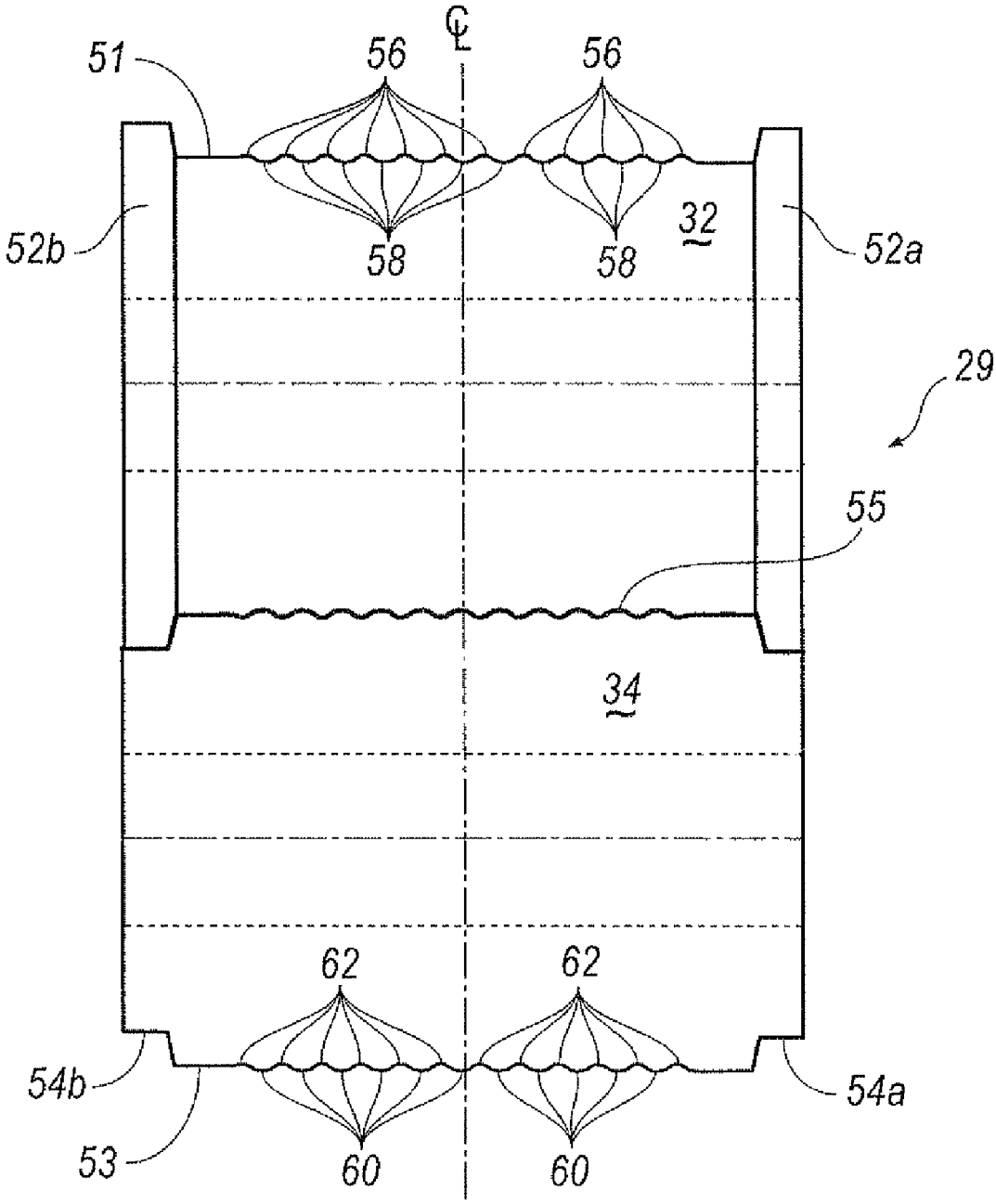
FIG. 3 is a front elevational view of an embodiment of a second smoothing pass of the roll mill depicted in FIG. 1.

A detailed view of second smoothing pass 29 is provided in FIG. 3. The roll stock is not shown in FIG. 3. Second smoothing pass 29 comprises generally cylindrical upper roll 32 and lower roll 34. Upper roll 32 includes a plurality of raised surface regions 56 that project away from reference surface 51 in a first direction, and a plurality of depressed surface regions 58 that project away from reference surface 51 in a second, opposite direction. Lower roll 34 includes a plurality of raised surface regions 60 which project away from reference surface 53 in a first direction and a plurality of depressed surface regions 62 which project away from reference surface 53 in a second, opposite direction. Upper roll 32 and lower roll 34 are mateable at their location of tangency to define a profile 55 between the upper roll 32 and lower roll 34 through which roll stock will be passed. As a result, the roll stock passing through upper roll 32 and lower roll 34 will be formed with profile 55. As indicated previously, first pass profile 45 and second pass profile 55 are substantial inverses of one another.

Raised surface regions 56 in upper roll 32 are substantially aligned with and complementary to depressed surface regions 62 in lower roll 34. Depressed surface regions 58 on upper roll 32 are substantially aligned with and complementary to raised surface regions 60 on lower roll 34. As with first smoothing pass 27, the raised and depressed regions of the rolls comprising second smoothing pass 29 may be convex and concave, respectively, or may be generally square or otherwise polygonal. In addition, each raised surface region 56 preferably has a maximum point that is substantially aligned with a corresponding minimum point on a depressed surface region 62. Each raised surface region 60 also preferably has a maximum point that is substantially aligned with a corresponding minimum point on depressed surface region 58.

Figure 4:
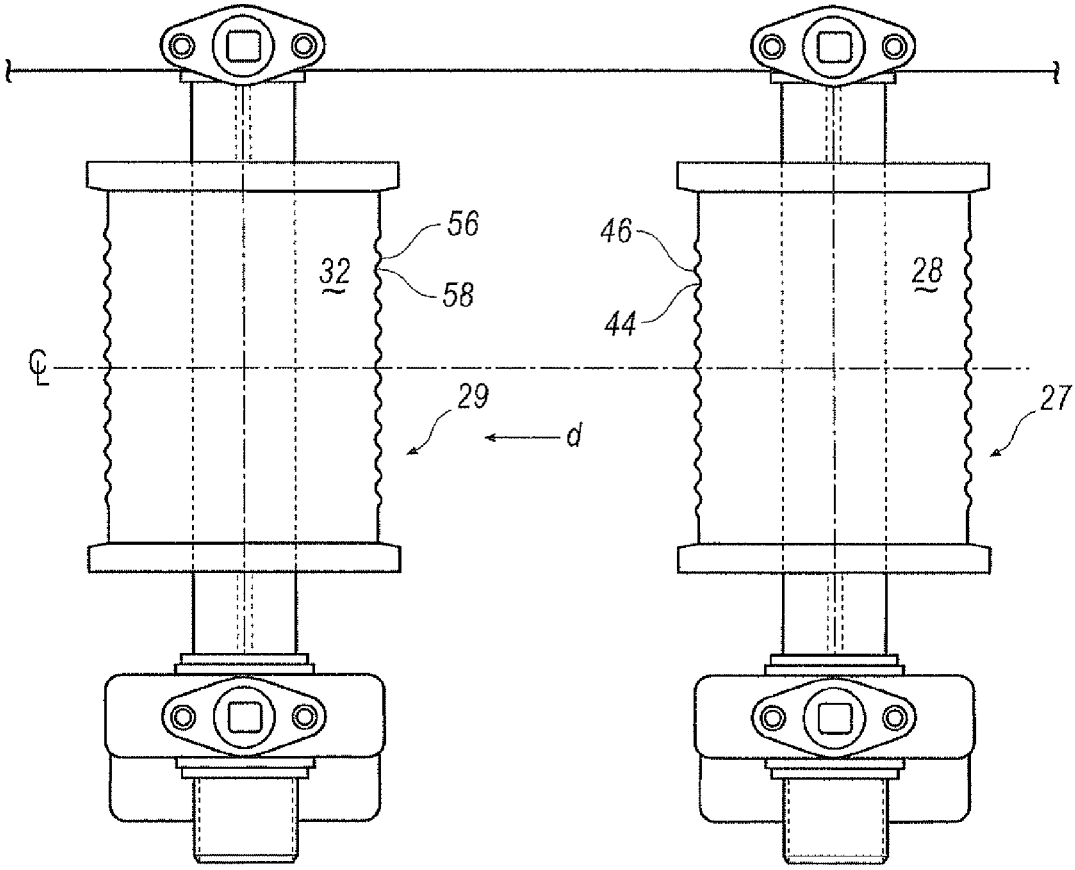
FIG. 4 is a top plan view of the first and second passes of the roll mill depicted in FIG. 1.

Raised regions 56 and depressed regions 58 preferably run around the circumference of upper roll 32 to define an alternating pattern of raised regions 56 and depressed regions 58 along the length of upper roll 32. Lower roll 34 is also provided with a similar pattern of raised regions 60 and depressed regions 62 around its circumference and along its length. Upper roll 32 may also include opposing roll flanges 52*a* and 52*b* at its ends which are generally complementary with recessed regions 54*a* and 54*b* formed at opposite ends of lower roll 34. As shown in FIG. 4, roll stock is fed in direction "d" from first smoothing pass 27 to second smoothing pass 29. Like first smoothing pass 27, the rolls of second smoothing pass 29 are preferably corrugated to create raised regions 56 and 60 and depressed regions 58 and 62.

Figure 5:
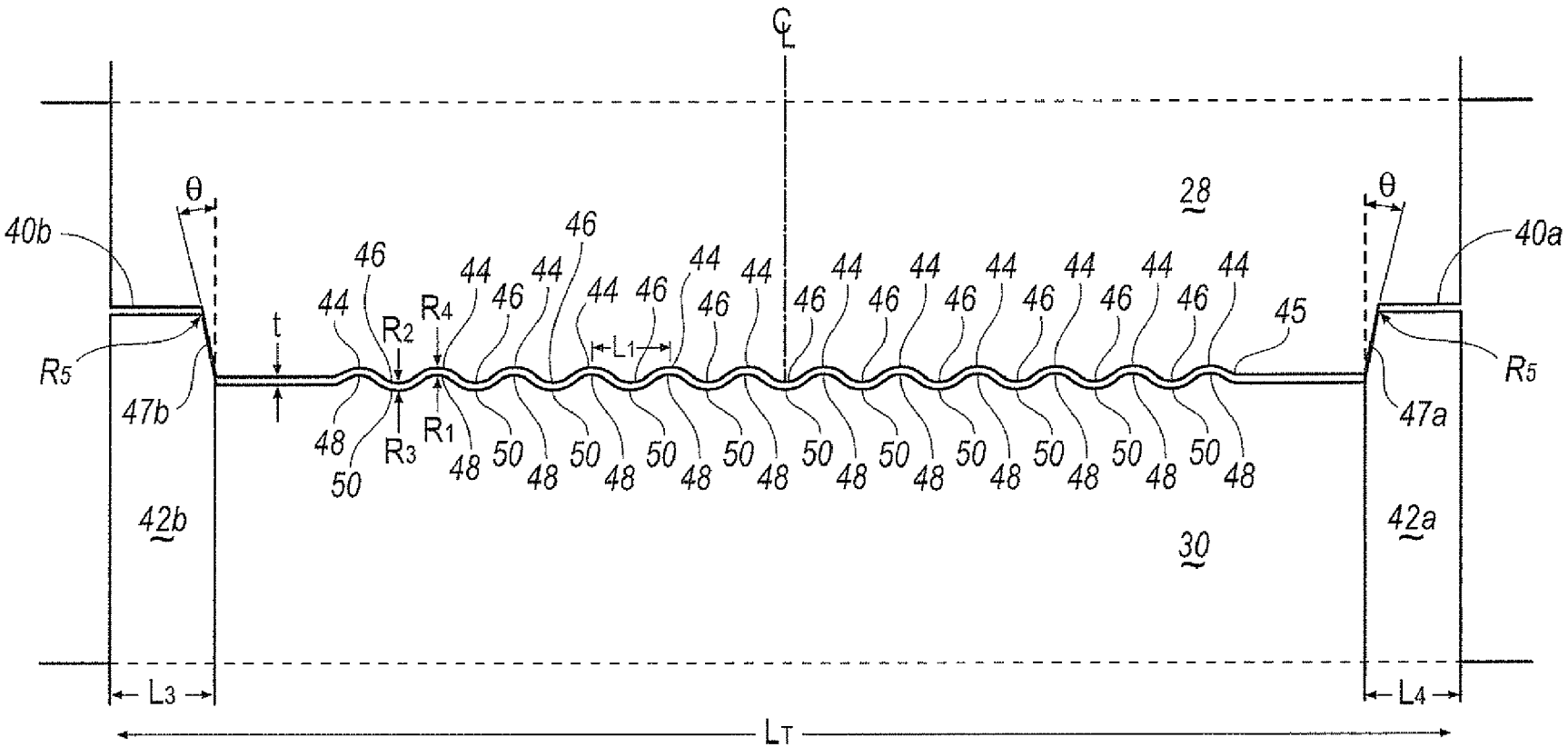
FIG. 5 is a view of a portion of the first smoothing pass of the roll mill of FIG. 1.

FIG. 5 is a detailed view of first smoothing pass 27 showing the engagement of upper roll 28 and lower roll 30 and profile 45 which is defined between upper roll 28 and lower roll 30 at their location of tangency to one another. As indicated in the figure, each raised region 48 of lower roll 30 preferably defines a radius of curvature R1, while each raised region 46 of upper roll 28 preferably defines a radius of curvature R2. In a preferred embodiment R1 and R2 are substantially equal. R1 and R2 range generally from about 0.1 to about 0.5 inches, and are preferably from about 0.15 to about 0.3 inches. A radius of about 0.2 inches is especially preferred.

Each depressed region 50 of lower roll 30 preferably defines a radius of curvature R3, while each depressed region 44 of upper roll 28 preferably defines a radius of curvature R4. In a preferred embodiment, R3 and R4 are substantially equal. R3 and R4 range generally from about 0.1 to about 0.5 inches and are preferably from about 0.2 to about 0.4 inches. A radius of about 0.248 inches is especially preferred. The difference between radii R1 and R4 preferably defines a thickness "t" which is equal to the difference between radii R2 and R3 and which substantially corresponds to the thickness of the roll stock being processed.

The numbers of raised and lowered regions on upper roll 28 and lower roll 30 are preferably selected based on the width of roll stock, the strength of the roll stock, and/or the degree of profile variations in the roll stock. The number of raised regions 46 and depressed regions 44 generally ranges from about 4 to about 20. About 8 to about 16 raised and depressed regions are preferred. As depicted in FIG. 5, in an especially preferred embodiment, the number of upper roll raised regions 46 is eleven (11) while the number of upper roll depressed regions 44 is twelve (12). The general and preferable ranges for the number of raised regions 48 and depressed regions 50 on lower roll 30 are similar. However, in an especially preferred embodiment, the number of raised regions 48 is twelve (12), and the number of depressed regions 50 is eleven (11). The peak-to-peak distance $L_1$ between adjacent maxima of raised regions 46, 48, 56, and 62 is also selected based on the design of the part and the roll stock materials, as is the peak to peak distance between adjacent minima of depressed regions 44, 50, 58, and 62.

In an exemplary embodiment, the total length $L_T$ of rolls 28 and 30 is about 10 inches, which is especially suited for rocker panel applications. However, a variety of different lengths may be used. The lengths $L_3$ and $L_4$ of flanges 42*a* and 42*b* are preferably such that the ratios $L_3/L_T$ and $L_4/L_T$ range from about 0.04 to about 0.12, with ratios of from about 0.05 to about 0.08 being preferred. In an especially preferred embodiment, $L_3/L_T$ is about 0.078 inches and $L_4/L_T$ is about 0.068 inches.

Upper roll 28 is preferably formed from a steel roll having an outer diameter from about 4 inches to about 8 inches which is machined to provide raised regions 46, depressed regions 44, and recessed portions 40*a* and 40*b*. In a preferred embodiment, the outer diameter of upper roll 28 prior to machining ranges from about 5 inches to about 7 inches. An outer diameter of 6.75 inches is especially preferred. In one embodiment, upper roll 28 is formed from two cylindrical half-rolls which are bolted together to form the completed roll. Lower roll 30 is preferably formed similarly and then bolted to opposing end flanges 42*a* and 42*b*.

Lower roll 30 is also preferably machined from a steel roll having the same radial dimensions as those of upper roll 28. However, end flanges 42*a* and 42*b* are formed from a steel roll having an outer diameter that is generally from about 6 to about 10 inches, preferably from about 7 to about 8 inches, and more preferably about 7.75 inches.

Referring again to FIG. 5, end flanges 42*a* and 42*b* include inwardly facing inner surfaces 47*a* and 47*b* which define an angle θ with respect to a vertical axis. The angle θ ranges generally from about 5 to about 15 degrees, with an angle of from about 6 to about 12 degrees being preferred. In an especially preferred embodiment, θ is about 10 degrees. In addition, inner surfaces 47*a* and 47*b* define a radius of curvature $R_5$ which ranges generally from about 0.05 inches to about 0.09 inches, with radii of from about 0.06 inches to about 0.08 inches being preferred. A radius of 0.07 inches is especially preferred.

Although FIG. 5 pertains specifically to first smoothing pass 27, the general and preferred dimensions described above also pertain to second smoothing pass 29. Thus, raised surface regions 56 and 60 preferably define radii of curvature that are substantially equal to the R1 and R2 radii of raised surface regions 46 and 48 in the upper and lower rolls of first smoothing pass 27. Depressed surface regions 58 and 62 preferably define radii of curvature that are substantially equal to the R3 and R4 radii of curvature of the depressed surface regions 44 and 50 of the upper and lower rolls of first smoothing pass 27. In addition, the dimensions of end flanges 52*a* and 52*b* are preferably substantially equal to those of end flanges 42*a* and 42*b* of first smoothing pass 27. However, as noted previously, the end flanges are preferably on the opposite roll (i.e., upper or lower) in the first smoothing pass 27 as compared to the second smoothing pass 29. The general and preferred ranges of the numbers of raised and depressed surface regions of the upper and lower rolls of second pass 29 are the same as for the upper and lower rolls of first smoothing pass 27. However, in an especially preferred embodiment, the number of raised surface regions 56 is twelve (12), the number of depressed surface regions 58 is eleven (11), the number of raised surface regions 60 is eleven (11) and the number of depressed surface regions 62 is twelve (12).

Figure 6:
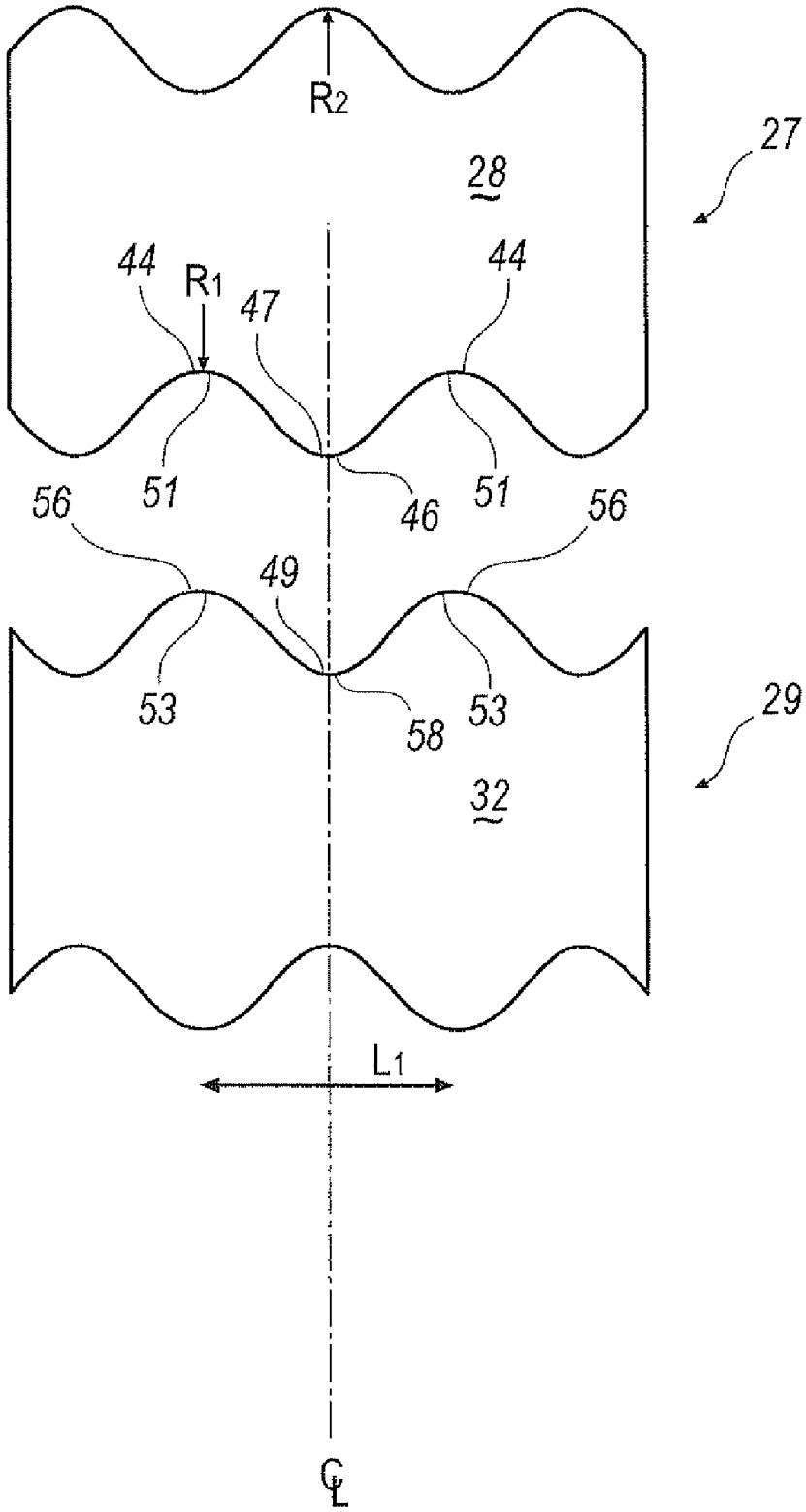
FIG. 6 is an exaggerated view of a portion of the first and second smoothing passes of the roll mill of FIG. 1, as seen from a top plan view.

As mentioned previously, first smoothing pass 27 and second smoothing pass 29 are preferably configured to depress select locations on the roll stock in one pass and then raise them in the other pass. To accomplish this, the first smoothing pass 27 and second smoothing pass 29 are preferably substantially complementary to and aligned with one another as depicted in FIG. 6. In addition, the upper rolls 28 and 32 of each pass preferably include surface profiles that are the substantial inverses of one another. Similarly, lower rolls 30 and 34 preferably include surface profiles that are the substantial inverses of one another.

Referring to FIG. 6, a portion of first smoothing pass upper roll 28 is shown with a portion of second smoothing pass upper roll 32. As indicated in the figure, the depressed regions 58 of upper roll 32 are preferably in substantial alignment with the raised regions 46 of upper roll 28. Similarly, depressed regions 44 of upper roll 28 are preferably in substantial alignment with raised regions 56 of upper roll 32. In a preferred embodiment, raised regions 46 include maxima 47 that are substantially aligned with minima 49 in depressed regions 58. Similarly, depressed regions 44 include minima 51 that are in substantial alignment with maxima 53 of raised regions 56.

Although not visible in FIG. 6, raised regions 48 of first smoothing pass lower roll 30 are also preferably in substantial alignment with depressed regions 62 of second smoothing pass lower roll 34. Depressed regions 50 of first smoothing pass lower roll 30 are also in substantial alignment with raised regions 60 of second smoothing pass lower roll 34. In first smoothing pass 27, bottom roll 30 is aligned with top roll 28 in the manner described previously, and in second smoothing pass 29 top roll 32 is aligned with bottom roll 34 in the manner described previously.

As a result of the foregoing configuration, as a roll stock passes through first smoothing pass 27, the roll stock regions that are aligned with raised regions 46 and depressed regions 50 (see FIGS. 2 and 5) will be deformed downward (i.e., towards bottom roll 30). The roll stock regions that are aligned with depressed regions 44 and raised regions 48 (see FIGS. 2 and 5) will be deformed upward (i.e., towards upper roll 28). However, as the roll stock passes through second smoothing pass 29, each region on it will be deformed in a direction opposite to that in which it was deformed in first smoothing pass 27. For example, portions of the roll stock that are aligned with raised regions 46 in first smoothing pass 27 will be deformed downward in first smoothing pass 27, but will then be deformed upward in second smoothing pass 29 as they pass between raised regions 60 and depressed regions 58 on the upper and lower rolls (see FIG. 3). Therefore, by placing the first and second roll passes in substantially complementary alignment, the roll stock is alternately deformed in opposite directions at various positions along its width, thereby reducing or eliminating profile variations, such as convexities, concavities, etc.

Figure 7:
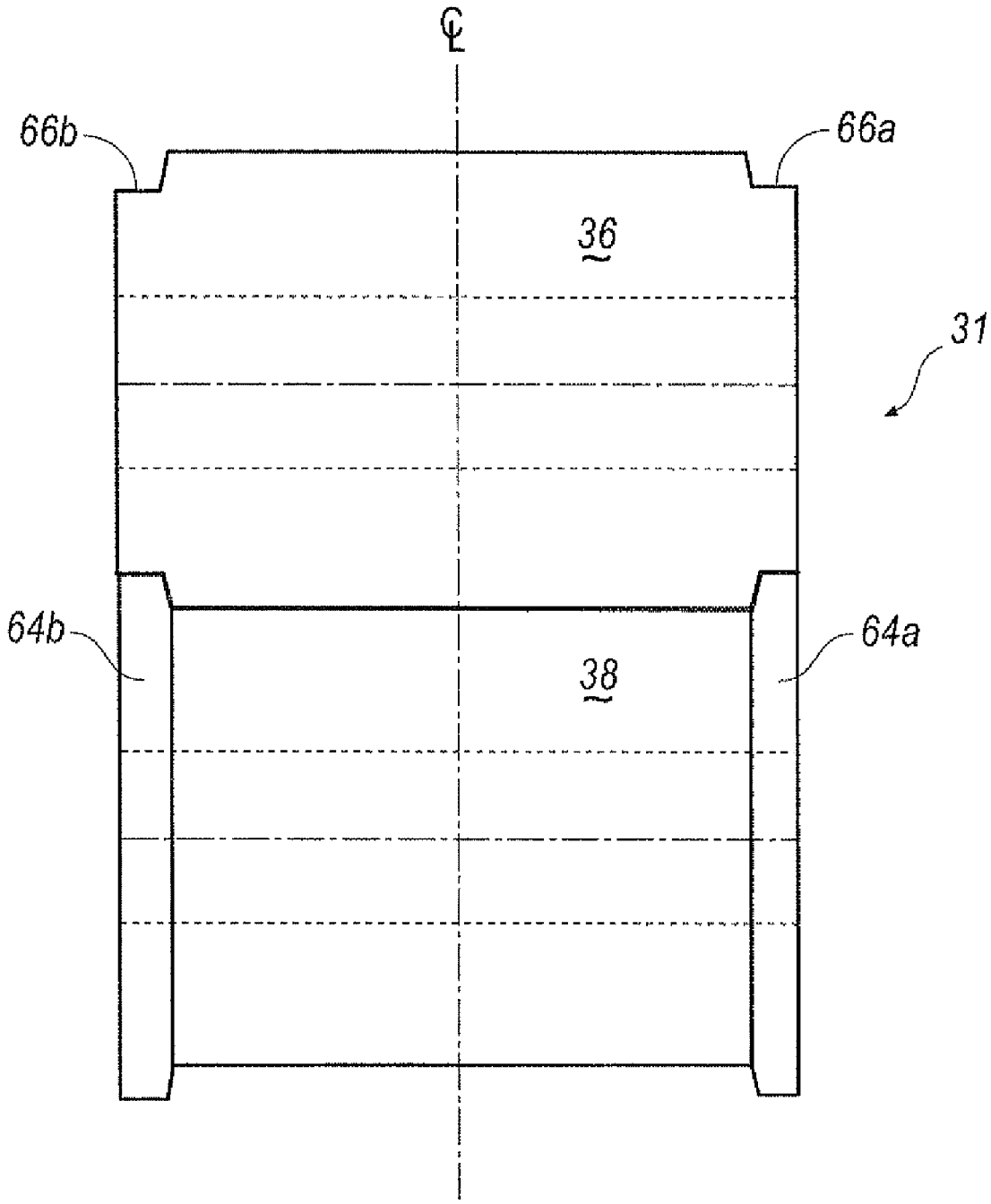
FIG. 7 is an embodiment of a third smoothing pass of the roll mill of FIG. 1.

If desired, additional rolls can be used to continue the smoothing process after first smoothing pass 27 and second smoothing pass 29. In one embodiment, depicted in FIG. 7, a pair of flattening rolls 36 and 38 comprise a third smoothing pass 31 through which the roll stock passes after exiting second smoothing pass 29. Unlike the rolls of first and second smoothing passes 28 and 29, rolls 36 and 38 have substantially smooth surfaces without surface features such as raised or depressed regions. The use of smooth surface rolls helps eliminate or reduce remaining profile variations in the roll stock. As indicated in FIG. 7, lower roll 38 may comprise a pair of end flanges 64*a* and 64*b* which are substantially complementary with corresponding recesses 66*a* and 66*b* around the circumference of upper roll 36.

In the exemplary roll forming apparatuses of FIGS. 2-6, raised and depressed regions (e.g., corrugations) are formed around the circumference of the rolls of a roll mill. However, raised and depressed regions may alternatively be formed in the lengthwise direction to extend along the length of the rolls. In addition, the raised and depressed surface regions may be formed in other directions lying between the circumferential and lengthwise directions. Also, instead of continuously raised and depressed regions that extend along the length or around the circumference of the rolls, discrete patterns of alternating peaks and valleys may be used. Any type of surface features which are capable of sequentially forming substantially inverse profiles on a sheet metal stock may be used.

As mentioned previously, the apparatuses and methods described herein can be used with other sheet metal forming processes such as stamping and pressing processes. For example, two smoothing passes can be provided in a stamping or pressing operation. In certain illustrative systems, each smoothing pass includes an upper and lower die platen having smoothing surfaces. The upper and lower die platens comprise smoothing surfaces that are mateable to impart a profile on a sheet metal placed between the platens. In certain exemplary configurations, in each pass the upper and lower die platens include alternating raised and depressed surface regions (e.g., corrugations, other alternating peaks and valleys) such that the smoothing surface of the upper die platen is substantially complementary to the smoothing surface of the lower die platen. The passes and surfaces are preferably configured such that each location on a sheet metal passing through the passes will be deformed in one direction in the first pass and then in a substantially opposite direction in the second pass.

In certain situations, it may be desirable to repeatedly form the same profile on a sheet metal before then forming a substantially inverse profile. It also may be desirable to then repeatedly impart the substantially inverse profile. This can readily be accomplished by multiplying and arranging the number of smoothing passes provided to achieve the desired result.

Figure 8:
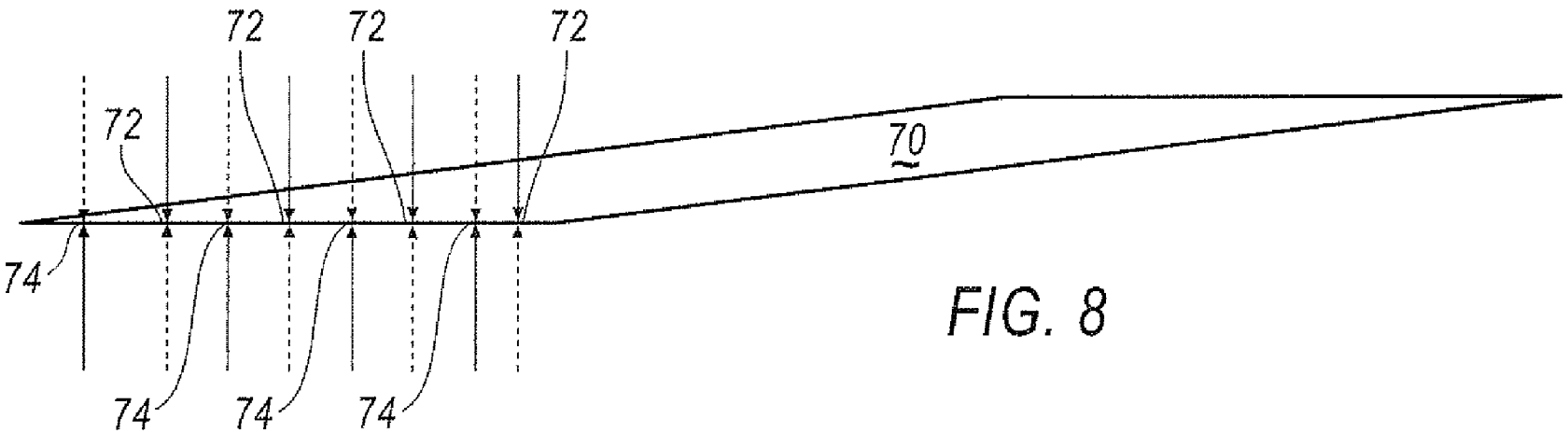
FIG. 8 is a depiction of a method for reducing profile variations in a roll stock.

Referring to FIG. 8, a method of reducing profile variations in a roll-stock will now be described. In accordance with the method, a high strength roll stock 70 is selected. Roll stock 70 generally has a minimum tensile strength of from about 1 kPSI to about 2 kPSI. Preferred minimum tensile strengths range from about 1.2 kPSI to about 1.8 kPSI. In an especially preferred embodiment, Martensite steel (Ispat Inland, Inc. of East Chicago, Ind.) having a minimum tensile strength of 1.3 kPSI is used. A variety of roll stock thicknesses may be used. In one embodiment, the roll stock thickness ranges generally from about 0.01 to about 0.10 inches, preferably from about 0.03 to about 0.07 inches, and more preferably is about 0.048 inches.

The roll stock 70 is deformed in a first direction (shown by the solid arrows) at a first plurality of locations 72 that are spaced apart along the width of the roll stock. The first plurality of locations 72 are then deformed in a second direction (shown by the dashed arrows), which is preferably substantially opposite the first direction.

In a preferred embodiment, at substantially the same time locations 72 are deformed in the direction indicated by the solid arrows, adjacent and alternating locations 74 are deformed in the substantially opposite direction (as also indicated by solid arrows). In addition, when locations 72 are deformed in the direction indicated by the dashed arrows, locations 74 are preferably deformed in the substantially opposite direction (as indicated by dashed arrows).

In an especially preferred embodiment, locations 72 and 74 are deformed in the direction of the solid arrows by inserting and compressing roll stock 70 between rolls 28 and 30 of first smoothing pass 27 (FIGS. 1 and 2) as roll stock 70 moves in direction "d" shown in FIG. 1. Locations 72 and 74 are deformed in the direction of the dashed arrows by inserting and compressing roll stock 70 between rolls 32 and 34 of second smoothing pass 29 (FIGS. 1 and 3). To obtain the desired deformation, smoothing passes 27 and 29 are preferably aligned in the manner shown in FIG. 6 and described previously. Raised regions 46 of roll 28 and depressed regions 50 of roll 30 are in substantial alignment with locations 72, causing those locations to deform in a downward direction in first smoothing pass 27. Depressed regions 58 of second smoothing pass upper roll 32 and raised regions 60 of second smoothing pass lower roll 34 are also in substantial alignment with locations 72, causing these locations to deform upward in second smoothing pass 29. Correspondingly, locations 74 are in substantial alignment with depressed regions 44 of roll 28 and raised regions 48 of roll 30, causing these locations to deform upward in first smoothing pass 27. However, locations 74 are in substantial alignment with raised regions 56 of roll 32 and depressed regions 62 of roll 34 causing them to deform downward in second smoothing pass 29. If desired, smoothing passes 27 and 29 could be configured to deform locations 72 upwardly in first smoothing pass 27 and downwardly in second smoothing pass 29. In addition, the sequence of deformations can be repeated in additional smoothing passes to further reduce profile variations.

Variations in the methods, over and above those indicated, are also possible. Thus, while the invention has been particularly shown and described above with reference to preferred embodiments, the foregoing and other changes in form and detail may be made therein by those skilled in the art without departing from the spirit and scope of the invention and the invention is to be limited only by the following claims:

The invention claimed is:

1. An apparatus for reducing profile variations in a sheet metal, comprising:

a first pass having first and second smoothing surfaces that are mateable to define a first profile between the first and second smoothing surfaces; and a second pass having third and fourth smoothing surfaces that are mateable to define a second profile between the third and fourth smoothing surfaces, wherein the first profile is substantially the inverse of the second profile, the first smoothing surface comprises a plurality of alternating raised surface regions and depressed surface regions, the second smoothing surface comprises a plurality of alternating raised surface regions and depressed surface regions, and the raised surface regions of the first smoothing surface are substantially aligned with the depressed surface regions of the second smoothing surface.

2. The apparatus of claim 1, wherein the third smoothing surface comprises a plurality of alternating raised surface regions and depressed surface regions, the fourth smoothing surface comprises a plurality of alternating raised surface regions and depressed surface regions, and the raised surface regions of the third smoothing surface are substantially complementary to the depressed surface regions of the fourth smoothing surface.

3. The apparatus of claim 1, wherein the raised surface regions of the first smoothing surface and the second smoothing surface are substantially convex, and the depressed surface regions of the first smoothing surface and the second smoothing surface are substantially concave.

4. An apparatus for reducing profile variations in roll stock, comprising:

a first pass including a first roll and a second roll, the second roll being spaced apart from the first roll in a first direction, the first roll and the second roll each having surface features such that the surface features of the first roll are substantially complementary to the surface features of the second roll; and a second pass spaced apart from the first pass in a second direction, the second pass including a third roll and a fourth roll, the fourth roll spaced apart from the third roll in the first direction, the third roll and the fourth roll each having surface features, such that the surface features of the third roll are substantially complementary to the surface features of the fourth roll, wherein the surface features of the third roll are complementary to the surface features of the first roll, the first roll has a first plurality of raised surface regions and a second plurality of depressed surface regions, the second roll has a third plurality of raised surface regions and a fourth plurality of depressed surface regions, the first plurality of raised surface regions is substantially aligned with the fourth plurality of depressed surface regions, and the third plurality of raised surface regions is substantially aligned with the second plurality of depressed surface regions, the third roll has a fifth plurality of raised surface regions and a sixth plurality of depressed surface regions, the fourth roll has a seventh plurality of raised surface regions and an eighth plurality of depressed surface regions, the fifth plurality of raised surface regions is substantially aligned with the eighth plurality of depressed surface regions, the seventh plurality of raised surface regions is substantially aligned with the sixth plurality of depressed surface regions, and the first plurality of raised surface regions is substantially aligned with the sixth plurality of depressed surface regions.

5. The apparatus of claim 4, wherein the first roll has a length, and the first plurality of raised surface regions and the second plurality of depressed surface regions define a pattern of alternating raised surface regions and depressed surface regions along the length of the first roll.

6. The apparatus of claim 4, wherein the raised surfaces in the first plurality of raised surface regions, the third plurality of raised surface regions, the fifth plurality of raised surface regions, and the seventh plurality of raised surface regions are convex.

7. The apparatus of claim 4, wherein the depressed surfaces in the second plurality of depressed surface regions, the fourth plurality of depressed surface regions, the sixth plurality of depressed surface regions, and the eight plurality of depressed surface regions are concave.

8. The apparatus of claim 4, wherein each raised surface in the first plurality of raised surface regions, the third plurality of raised surface regions, the fifth plurality of raised surface regions, and the seventh plurality of raised surface regions has a maximum, each depressed surface in the second plurality of depressed surface regions, the fourth plurality of depressed surface regions, the sixth plurality of depressed surface regions, and the eighth plurality of depressed surface regions has a minimum, the maxima of the first plurality of raised surface regions are substantially aligned with the minima of the fourth plurality of depressed surface regions, the minima of the second plurality of depressed surface regions are substantially aligned with the maxima of the third plurality of raised surface regions, the maxima of the fifth plurality of raised surface regions are substantially aligned with the minima of the eighth plurality of depressed surface regions, the minima of the sixth plurality of depressed surface regions are substantially aligned with the maxima of the seventh plurality of raised surface regions, and the maxima of the first plurality of raised surface regions are substantially aligned with the minima of the sixth plurality of depressed surface regions.

9. The apparatus of claim 4, wherein the first roll, the second roll, the third roll, and the fourth roll each have a length, the first plurality of raised surface regions and the second plurality of depressed surface regions define a pattern of alternating raised regions and depressed regions along at least a portion of the length of the first roll, the third plurality of raised regions and the fourth plurality of depressed regions define a pattern of alternating raised regions and depressed regions along at least a portion of the length of the second roll, the fifth plurality of raised regions and the sixth plurality of depressed regions define a pattern of alternating raised regions and depressed regions along at least a portion of the length of the third roll, and the seventh plurality of raised regions and the eight plurality of depressed regions define a pattern of alternating raised regions and depressed regions along the length of the fourth roll.

10. An apparatus for reducing profile variations in roll stock, comprising: a first pass including a first roll and a second roll, the second roll being spaced apart from the first roll in a first direction, the first roll and the second roll each having surface features such that the surface features of the first roll are substantially complementary to the surface features of the second roll; and a second pass spaced apart from the first pass in a second direction, the second pass including a third roll and a fourth roll, the fourth roll spaced apart from the third roll in the first direction, the third roll and the fourth roll each having surface features, such that the surface features of the third roll are substantially complementary to the surface features of the fourth roll, wherein the surface features of the third roll are complementary to the surface features of the first roll, the first roll has a length, and the surface features of the first roll comprise a plurality of ridges spaced apart along the length of the first roll.

11. The apparatus of claim 10, wherein the first roll has a circumference and the plurality of ridges is disposed around the circumference of the first roll.

12. An apparatus for reducing profile variations in roll stock, comprising: a first pass including a first roll and a second roll, the second roll being spaced apart from the first roll in a first direction, the first roll and the second roll each having surface features such that the surface features of the first roll are substantially complementary to the surface features of the second roll; and a second pass spaced apart from the first pass in a second direction, the second pass including a third roll and a fourth roll, the fourth roll spaced apart from the third roll in the first direction, the third roll and the fourth roll each having surface features, such that the surface features of the third roll are substantially complementary to the surface features of the fourth roll, wherein the surface features of the third roll are complementary to the surface features of the first roll, and the first roll, the second roll, the third roll, and the fourth roll are corrugated.

13. An apparatus for reducing profile variations in a roll stock moving in a processing direction, comprising:

a first smoothing pass spaced apart from a second smoothing pass in the processing direction, wherein the first pass comprises a first upper roll having a first plurality of raised surface regions and a second plurality of depressed surface regions, the second smoothing pass comprises a second upper roll having a third plurality of raised surface regions and a fourth plurality of depressed surface regions, the first plurality of raised surface regions is substantially aligned with the fourth plurality of depressed surface regions, and the third plurality of raised surface regions is substantially aligned with the second plurality of depressed surface regions.

14. The apparatus of claim 13, wherein the first upper roll has a length and a circumference, the first plurality of raised surface regions comprises a first plurality of ridges, the ridges in the first plurality of ridges are disposed around the circumference of the first roll and spaced apart from one another long the length of the roll, the second upper roll has a length and a circumference, the second plurality of raised surface regions comprises a second plurality of ridges, and the ridges in the second plurality of ridges are disposed around the circumference of the second roll and spaced apart from one another along the length of the second upper roll.

15. A method of reducing surface variations in a roll stock having a width, the method comprising:

deforming the roll stock in a first direction at a first plurality of locations that are spaced apart along the width of the roll stock; and deforming the roll stock in a second direction at the first plurality of locations, wherein the first direction is substantially opposite from the second direction, wherein the step of deforming the roll stock in a first direction at a first plurality of locations further comprises substantially contemporaneously deforming the roll stock in the second direction at a second plurality of locations that are spaced apart along the width of the roll stock, and the step of deforming the roll stock in a second direction at the first plurality of locations further comprises substantially contemporaneously deforming the roll stock in the first direction at the second plurality of locations.

* * * * *

UNITED STATES PATENT AND TRADEMARK OFFICE

CERTIFICATE OF CORRECTION

PATENT NO. : 7,958,763 B2
APPLICATION NO. : 11/843366
DATED : June 14, 2011
INVENTOR(S) : Ligda It is certified that error appears in the above-identified patent and that said Letters Patent is hereby corrected as shown below:

Column 14, line 12, delete “long” and insert --along--.

Signed and Sealed this
Twelfth Day of July, 2011

David J. Kappos

David J. Kappos
*Director of the United States Patent and Trademark Office*